US006232867B1

(12) United States Patent
Yoshida et al.

(10) Patent No.: US 6,232,867 B1
(45) Date of Patent: May 15, 2001

(54) METHOD OF FABRICATING MONOLITHIC VARISTOR

(75) Inventors: Yoshikazu Yoshida, Shiga-ken; Toru Tominaga, Yokaichi; Tadashi Morimoto, Hikone, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/643,500

(22) Filed: Aug. 22, 2000

(30) Foreign Application Priority Data

Aug. 27, 1999 (JP) ..... 11-240738
Jul. 25, 2000 (JP) ..... 12-223336

(51) Int. Cl.[7] ..... H01C 7/10; H01C 7/13

(52) U.S. Cl. ..... 338/21; 338/20; 338/307; 338/309; 29/610.1; 29/619

(58) Field of Search ..... 338/20, 21, 307, 338/309, 332, 314, 312; 29/610.1, 619, 620

(56) References Cited

U.S. PATENT DOCUMENTS 4,064,475 * 12/1977 Kouchich et al. ..... 338/20
4,657,699 * 4/1987 Nair ..... 252/513
4,692,735 * 9/1987 Shoji et al. ..... 338/21
4,946,709 * 8/1990 Takada et al. ..... 427/98
5,750,264 * 5/1998 Ueno et al. ..... 428/426
5,866,196 * 2/1999 Ueno et al. ..... 427/79
5,973,588 * 10/1999 Cowman et al. ..... 338/21
5,994,995 * 11/1999 Ogasawara et al. ..... 338/21

* cited by examiner

*Primary Examiner*—Michael L. Gellner
*Assistant Examiner*—Richard K. Lee
(74) *Attorney, Agent, or Firm*—Ostrolenk, Faber, Gerb & Soffen, LLP

(57) ABSTRACT

A method of fabricating a monolithic chip varistor includes the steps of preparing a varistor body including a plurality of varistor layers and at least one pair of internal electrodes; forming a first layer for each of a pair of external electrodes by applying a metal component and a glass component to an exterior portion of the varistor body, followed by heat treatment; forming a second layer for the external electrode on the first layer by applying a glass component, followed by heat treatment; forming a third layer for the external electrode on the second layer by applying a glass component that is different from the glass component used for forming the second layer, followed by heat treatment; forming a fourth layer for the external electrode on the third layer by applying a metal component that is different from the metal component used for forming the first layer, followed by heat treatment under the same heat treatment conditions as those used for the formation of the first layer; and forming a fifth layer for the external electrode by electroplating. During the heat treatment for forming the fourth layer, the metal component contained in the fourth layer is diffused into the second layer and the third layer.

24 Claims, 1 Drawing Sheet

METHOD OF FABRICATING MONOLITHIC VARISTOR

BACKGROUND OF THE INVENTION

1. Field of the Invention

The present invention relates to methods of fabricating monolithic chip varistors and to monolithic chip varistors. More particularly, the invention relates to improvements in a method of forming external electrodes in a monolithic chip varistor.

2. Description of the Related Art

A monolithic chip varistor is generally provided with a varistor body including a plurality of varistor layers composed of a zinc oxide-based ceramic material and at least one pair of internal electrodes opposed to each other with one of the varistor layers therebetween, and a pair of external electrodes, each formed on a specific portion of the external surface of the varistor body. Each external electrode is electrically connected to either one of the internal electrodes opposed to each other with a specific varistor layer therebetween.

In the monolithic chip varistor as described above, the external electrode typically includes a plurality of layers composed of different materials, and an outermost layer thereof, which is composed of a metal film having satisfactory solderability so as to impart satisfactory solderability to the external electrode. Such a metal film having satisfactory solderability is usually formed by electroplating.

A conventional technique, which is of interest in the present invention, concerning a monolithic ceramic electronic component provided with external electrodes as described above is disclosed, for example, in Japanese Unexamined Patent Application Publication No. 8-97072.

The above publication describes a method in which a first external electrode layer containing glass frit is formed on each end face of an electronic component body composed of a ceramic so as to be electrically connected to internal electrodes, and a second external electrode layer without containing glass frit is formed thereon, and then an outermost layer is formed by electroplating.

However, if the method disclosed in Japanese Unexamined Patent Application Publication No. 8-97072 is used in forming external electrodes on a varistor body provided with varistor layers composed of a zinc oxide-based ceramic material, since the zinc oxide-based ceramic material has relatively low electrical resistance, a potential difference between the external electrode, for example, the second layer, and the exposed surface of the varistor body becomes relatively small. Therefore, when electroplating is performed, the exposed surface of the varistor body is reduced and a plating film may be formed both on the external surface of the varistor body and on the second layer, resulting in degradation in the characteristics of the monolithic chip varistor.

Since the zinc oxide-based ceramic material is also easily affected by acids or alkalis, when the exposed surface of the varistor body is brought into contact with a plating solution during electroplating, dissolution occurs, resulting in deterioration of the varistor body, and it becomes difficult to maintain the varistor characteristics.

Furthermore, since the outermost layer for the external electrode is formed when electroplating is performed, internal defects easily occur in the varistor body, which may also result in degradation in the characteristics of the monolithic chip varistor. The problem is believed to be caused by the plating solution penetrating into the varistor body through a space between the external electrode and the varistor body, etc. The penetration of the plating solution at a section where the internal electrodes are located particularly causes a more serious problem, such as deterioration of the joint between the internal electrodes and the varistor layers, resulting in degradation in the characteristics of the monolithic chip varistor, particularly, in a life test.

The problem due to the contact between the exposed surface of the varistor body and the plating solution can be solved to a certain extent by covering the exposed surface of the varistor body with a glass film, for example, as disclosed in Japanese Unexamined Patent Application Publication No. 8-153607.

However, it is relatively difficult to form a glass film only on the exposed surface of the varistor body with high accuracy. For example, the glass film may also be formed on the external electrode portion, or the exposed surface maybe insufficiently covered with the glass film. In the former case, the formation of the outermost plating layer is blocked, and in the latter case, the problems associated with a case when such a glass film is not formed cannot be overcome completely.

SUMMARY OF THE INVENTION

Accordingly, it is an object of the present invention to provide a method of fabricating a monolithic chip varistor and a structure of a monolithic chip varistor obtained by the same method, in which the problems described above can be solved.

In accordance with the present invention, a method of fabricating a monolithic chip varistor includes the steps of preparing a varistor body including a plurality of varistor layers composed of a zinc oxide-based ceramic material and at least one pair of internal electrodes opposed to each other with one of the varistor layers therebetween;

forming a first layer for each of a pair of external electrodes by applying a metal component and a glass component to respective exterior portions of the varistor body so as to be electrically connected to a specific internal electrode, followed by heat treatment;

forming a second layer for the external electrode on the first layer by applying a glass component, followed by heat treatment;

forming a third layer for the external electrode on the second layer by applying a glass component that is different from the glass component used for forming the second layer, followed by heat treatment;

forming a fourth layer for the external electrode on the third layer by applying a metal component that is different from the metal component used for forming the first, followed by heat treatment under the same heat treatment conditions as those used for the formation of the first layer; and forming a fifth layer for the external electrode by forming an electroplating layer composed of a metal having satisfactory solderability.

During the heat treatment for forming the fourth layer, the metal component contained in the fourth layer is diffused into the second layer and the third layer.

Preferably, in the step of forming the first layer, the amount of the glass component is set at 5% to 10% by weight relative to the metal component.

And, preferably, in the step of forming the fourth layer, the amount of the glass component is set at less than 5% by weight relative to the metal component.

Preferably, simultaneously with the formation of the second layer, a first insulating layer composed of the glass component contained in the second layer is formed on the surface of the varistor body exposed from the first layer, and simultaneously with the formation of the third layer, a second insulating layer composed of the glass component contained in the third layer is formed on the first insulating layer.

The present invention is also directed to a structure of a monolithic chip varistor fabricated by the method described above.

More specifically, in accordance with the present invention, a monolithic chip varistor is provided with a varistor body including a plurality of varistor layers composed of a zinc oxide-based ceramic material and at least one pair of internal electrodes opposed to each other with one of the varistor layers therebetween, and a pair of external electrodes, each formed on an exterior portion of the varistor body. Each external electrode is electrically connected to either one of the internal electrodes opposed to each other with a specific varistor layer therebetween.

Each external electrode includes a first layer formed on the exterior portion of the varistor body and electrically connected to the internal electrodes, a second layer formed on the first layer, a third layer formed on the second layer, a fourth layer formed on the third layer, and a fifth layer formed on the fourth layer.

The first layer contains a metal component and a glass component, the second layer contains a glass component, the third layer contains a glass component that is different from the glass component contained in the second layer, the fourth layer contains a metal component that is different from the metal component contained in the first layer, and the fifth layer contains an electroplating film composed of a metal having satisfactory solderability.

The second layer and the third layer further contain the metal component contained in the fourth layer.

Preferably, the first layer contains 5% to 10% by weight of the glass component relative to the metal component.

And, preferably, the fourth layer contains less than 5% by weight of the glass component relative to the metal component.

Preferably, the monolithic chip varistor is provided with a first insulating layer composed of the glass component contained in the second layer on the exterior portion of the varistor body other than the portion for forming the external electrode, and a second insulating layer composed of the glass component contained in the third layer, formed on the first insulating layer.

Preferably, the metal component contained in the first layer comprises Ag or an AgPd alloy, the metal component contained in the second layer and the third layer comprises Ag, and the metal component contained in the fourth layer comprises Ag.

Preferably, the glass component contained in the second layer comprises boron-silica-zinc-based glass, and the glass component contained in the third layer comprises lead-boron-silica-zinc-based glass.

Preferably the glass component contained in the first layer and the glass component contained in the fourth layer comprise at least one material selected from the group consisting of lead, boron, and silica.

Other features and advantages of the present invention will become apparent from the following description of the invention which refers to the accompanying drawings.

DESCRIPTION OF THE PREFERRED EMBODIMENTS

Figure 1:
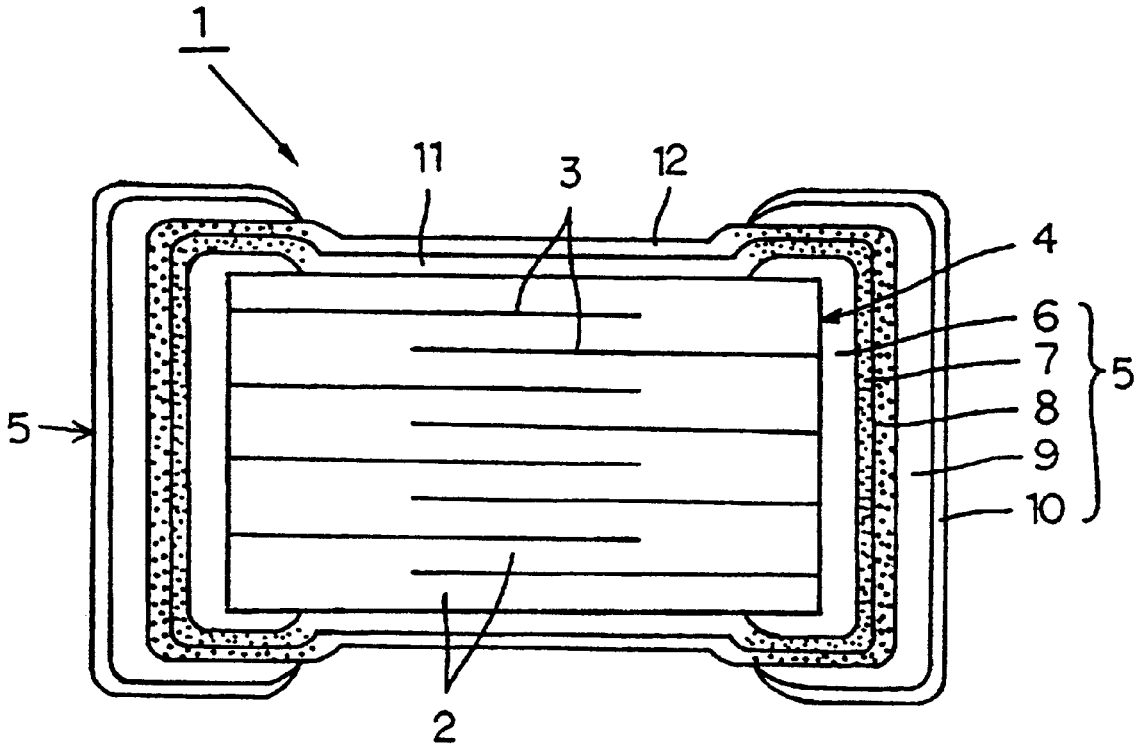
FIG. 1 is a sectional view of a monolithic chip varistor in accordance with an embodiment of the present invention.

FIG. 1 is a sectional view which shows a monolithic chip varistor 1 in accordance with an embodiment of the present invention.

The monolithic chip varistor 1 is provided with a varistor body 4 including a plurality of varistor layers 2 composed of a zinc oxide-based ceramic material and a plurality of pairs of internal electrodes 3 opposed to each other with one of the varistor layers 2 therebetween.

The varistor body 4 is fabricated, for example, by a method described below.

An organic binder, a dispersing agent, and a plasticizer are added to a raw material mixture containing powders of zinc oxide, bismuth oxide, and the like, and a sheet-forming slurry is prepared.

The sheet-forming slurry is formed into ceramic green sheets having a predetermined thickness by a doctor blade process.

Next, the ceramic green sheets are die-cut so as to have a rectangular shape of a predetermined size. A paste containing Ag for forming internal electrodes 3 is applied to specific ceramic green sheets, and a plurality of the ceramic green sheets are laminated and pressed, and then cut into a predetermined size to produce a plurality of green chips for forming varistor bodies 4.

The green chips are subjected to binder-removal treatment, for example, at 400 to 500° C., and then are fired, for example, at 880 to 920° C., to obtain sintered varistor bodies 4.

A pair of external electrodes 5 are formed on specific portions of the external surface (an exterior portion) of each of such varistor bodies 4. Each external electrode 5 includes a first layer 6 formed on the external surface of the varistor body 4 and electrically connected to the internal electrodes 3, a second layer 7 formed on the first layer 6, a third layer 8 formed on the second layer 7, a fourth layer 9 formed on the third layer 8, and a fifth layer 10 formed on the fourth layer 9.

The first layer 6 contains a metal component and a glass component, the second layer 7 contains a glass component, the third layer 8 contains a glass component that is different from the glass component contained in the second layer 7, the fourth layer 9 contains a metal component that is different from the metal component contained in the first layer 6 and a glass component, and the fifth layer 1 0 contains an electroplating film composed of a metal having satisfactory solderability. The second layer 7 and the third layer 8 further contain the metal component contained in the fourth layer 9.

A first insulating layer 11 composed of the glass component contained in the second layer 7 is formed on the external surface of the varistor body 4 excluding the portion in which the external electrodes 5 are formed, and a second insulating layer 12 composed of the glass component contained in the third layer 8 is formed thereon.

As the metal component contained in the first layer 6, for example, at least one metal selected from the group consisting of Ag, Pd, Au, and Pt may be used, and preferably, an AgPd alloy is used. The metal component contained in the second layer 7 and the third layer 8 preferably comprises Ag. As the metal component contained in the fourth layer 9, for example, at least one of Ag and Pd may be used, and preferably, Ag is used. The plating film contained in the fifth layer 10 may be, for example, composed of a nickel-plating film and a tinning film formed thereon, composed of a nickel-plating film and a solder-plating film formed thereon, or composed of a solder-plating film alone.

The glass component contained in the second layer 7 preferably comprises boron-silica-zinc-based glass, and the glass component contained in the third layer 8 preferably comprises lead-boron-silica-zinc-based glass.

Preferably, the glass component contained in the first layer 6 comprises at least one material selected from the group consisting of lead, boron, and silica The external electrode 5 and the insulating layers 11 and 12 are fabricated, for example, by a method described below.

First, the first layer 6 is formed by applying a paste containing, for example, an AgPd alloy containing 90% by weight of Ag as the metal component and 5% to 10% by weight of lead-silica-boron-based glass as the glass component to the external surface of the varistor body 4, followed by baking at 880 to 920° C.

Next, the second layer 7 and the first insulating layer 11 are formed by applying a glass component to the first layer 6 and the external surface of the varistor body 4 exposed from the first layer 6, namely, over the entire external surface of a structure obtained by forming the first layer 6 on the varistor body 4, followed by heat treatment under the conditions enabling the formation of the glass film. As the glass component, boron-silica-zinc-based glass is preferably used.

More specifically, for example, several thousands of varistor bodies 4 provided with the first layers 6 are placed in an alumina pot, 1% to 2% by weight of powdered boron-silica-zinc-based glass is added to the varistor bodies 4, and by heating at 800 to 900° C. while rotating at low speed, a glass film constituting the second layer 7 and the first insulating layer 11 is formed on the first layer 6 up to the exposed surface of the varistor body 4.

Next, the third layer 8 and the second insulating layer 12 are formed by applying a glass component that is different from the glass component used for forming the second layer 7 to the second layer 7 and the first insulating layer 11, namely, over the entire external surface of the structure in which the second layer 7 and the first insulating layer 11 have been formed, followed by heat treatment under the conditions enabling the formation of the glass film. As the glass component, lead-boron-silica-zinc-based glass is preferably used.

More specifically, for example, several thousands of varistor bodies 4 provided with the second layers 7 and the first insulating layers 11 are placed in an alumina pot, 1% to 2% by weight of powdered lead-boron-silica-zinc-based glass is added to the varistor bodies 4, and by heating at 700 to 800° C. while rotating at low speed, a glass film constituting the third layer 8 and the second insulating layer 12 is formed on the second layer 7 up to the first insulating layer 11.

The fourth layer 9 is formed by applying a metal component that is different from the metal component used for forming the first layer 6 to the third layer 8, followed by heat treatment under substantially the same conditions as those for forming the first layer 6. For example, as the metal component, Ag is used.

And, in the step of forming the fourth layer 9, by including an amount of glass component, higher strength of the fifth layer 5 is obtained. In this case, preferably, the fourth layer 9 contains the glass component at less than 5% by weight relative to the metal component. If the fourth layer 9 contains the glass component at more than 5% by weight, a wettabitily of electroplating layer of the fifth layer 10 may decrease. For example, as the glass component, lead-silica-boron glass is used.

More specifically, the fourth layer 9 is formed by applying a paste containing Ag as the metal component and 0.2% to 5% by weight of lead-silica-boron-based glass as the glass component to the third layer 8, followed by baking at 600 to 700° C.

In the heat treatment for forming the fourth layer 9, the metal component contained in the fourth layer 9 is diffused into the second layer 7 and the third layer 8, each containing the glass component. For example, Ag contained in the fourth layer 9 is diffused into the second layer 7 and the third layer 8, and thus electrical connection between the first layer 6 and the fourth layer 9 is obtained.

Next, the fifth layer 10 is formed by electroplating a metal having satisfactory solderability on the fourth layer 9. More specifically, a nickel-plating layer and a tinning layer thereon are formed by electroplating on the fourth layer 9.

In the external electrode 5 of the monolithic chip varistor 1 thus obtained, the first layer 6 provides a satisfactory electrical connection to the internal electrodes 3. As described above, also by incorporating, for example, 5% to 10% by weight of the glass component, the sinterability of the first layer 6 is improved, and thus the density of the first layer 6 is increased, ensuring the prevention of the penetration of the plating solution.

The first insulating layer 11 enables satisfactory adhesion between the external surface of the varistor body 4 and the second insulating layer 12 and ensures insulating properties of the varistor body 4 at the external surface. As the glass component contained in the second layer 7 and the first insulating layer 11, a composition which does not degrade the characteristics of the varistor body 4, even if diffused into the varistor body 4, is preferably used, and in order to meet this requirement, the boronsilica-zinc-based glass described above is preferably used.

The second insulating layer 12 preferably contains a glass component having a composition with superior wettabitily toward glass, and thus the second insulating layer 12 can form a uniform film on the first insulating layer 11 to impart satisfactory resistance to plating solutions as well as to inhibit plating from growing in an unwanted region on the external surface of the varistor body 4. For that purpose, the lead-boron-silica-zinc-based glass described above is preferably used.

Although the interspersion of glass resulting from the formation of the third layer 8 in the region in which the external electrode 5 is to be formed hampers the application of plating, the fourth layer 9 improves the application of plating. By forming the fourth layer 9, the metal component contained in the fourth layer 9 diffuses into the second layer 7 and the third layer 8, and thus electrical connection is obtained between the first layer 6 and the fourth layer 9.

The fifth layer 10 imparts satisfactory solderability to the external electrode 5. The nickel-plating layer contained in the fifth layer 10 also prevents Ag from migrating.

In the monolithic chip varistor, a clear border can still less appear between the second layer 7 and the third layer 8. However, as far as these layers originally contain mutually different glass component, there should be the second layer 7 and the third layer 8.

In addition, in the second layer 7 and the third layer 8, the glass component contained there may partially coexist with the metal component contained in the first layer 6 and the fourth layer 9. Then it seems that the second layer 7 and the third layer 8 are not formed partially. However, in the above-mentioned case, there is no problem as to the characteristics of the monolithic chip varistor. And, the present invention includes such a case.

As described above, in the method of fabricating the monolithic chip varistor in accordance with the present invention, in order to form the external electrode on the external surface of the varistor body, the first layer is formed by applying a metal component and a glass component to the external surface of the varistor body, followed by heat treatment; the second layer is formed on the first layer by applying a glass component, followed by heat treatment under the conditions enabling the formation of the glass film; the third layer is formed on the second layer by applying a glass component that is different from the glass component used for forming the second layer; the fourth layer is formed on the third layer by applying a metal component that is different from the metal component used for forming the first layer and a glass component, followed by heat treatment under the same conditions as those used for forming the first layer; and the fifth layer is formed by forming an electroplating film composed of a metal having satisfactory solderability on the fourth layer. During the heat treatment for forming the fourth layer, the metal component contained in the fourth layer is diffused into the second layer and the third layer.

Consequently, due to the existence of the first layer and the fourth layer, in particular, due to the existence of the first layer having a dense structure containing the glass component, a plating solution used in electroplating for forming the fifth layer is prevented from penetrating into the varistor body, and high reliability of the monolithic chip varistor can be secured.

With respect to the first layer, by setting the amount of the glass component at 5% to 10% by weight relative to the metal component, higher sinterability is obtained and the first layer has a denser structure. Therefore, the effect of preventing the penetration of the plating solution is increased and the reliability of the monolithic chip varistor is further increased.

And, with respect to the fourth layer, by setting the amount of the glass component at less than 5% by weight relative to the metal component, higher strength is obtained without lowering the wettabitily of electroplating layer of the fifth layer to the fourth layer.

In the present invention, if the first insulating layer composed of the glass component contained in the second layer is formed on the external surface of the varistor body excluding the portion in which the external electrode is formed, and the second insulating layer composed of the glass component contained in the third layer is formed on the first insulating layer, satisfactory resistance to plating solutions is imparted to the exposed surface of the varistor body, and also the electroplating film in the fifth layer can be inhibited from growing in the unwanted region on the external surface of the varistor body excluding the portion in which the external electrode is formed. The humidity resistance of the monolithic chip varistor can also be improved.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of fabricating a monolithic chip varistor comprising the steps of:

preparing a varistor body comprising a plurality of varistor layers comprising a zinc oxide-based ceramic material and at least one pair of internal electrodes opposed to each other with one of the varistor layers therebetween;

forming a first layer for each of a pair of external electrodes by applying a metal component and a glass component to respective exterior portions of the varistor body so as to be electrically connected to a respective internal electrode, followed by a first heat treatment;

forming a second layer for the external electrode on the first layer by applying a glass component, followed by a second heat treatment;

forming a third layer for the external electrode on the second layer by applying a glass component which is different from the glass component used for forming the second layer, followed by a third heat treatment;

forming a fourth layer for the external electrode on the third layer by applying a metal component which is different from the metal component used for forming the first layer, followed by a fourth heat treatment under the same heat treatment conditions as those used for the first heat treatment; and forming a fifth layer for the external electrode by forming an electroplating layer comprising a metal having a desired solderability, wherein during the heat treatment for forming the fourth layer, the metal component contained in the fourth layer is diffused into the second layer and the third layer.

2. A method of fabricating a monolithic chip varistor according to claim 1, wherein in the step of forming the first layer, the amount of the glass component is set at 5% to 10% by weight relative to the metal component.

3. A method of fabricating a monolithic chip varistor according to any one of claims 1 and 2, wherein in the step of forming the fourth layer, the amount of the glass component is set at less than 5% by weight relative to the metal component.

4. A method of fabricating a monolithic chip varistor according to any one of claims 1 and 2, wherein in the step of forming the second layer, a first insulating layer comprising the glass component contained in the second layer is simultaneously formed on the surface of the varistor body exposed from the first layer, and in the step of forming the third layer, a second insulating layer comprising the glass component contained in the third layer is simultaneously formed on the first insulating layer.

5. A method of fabricating a monolithic chip varistor according to claim 3, wherein in the step of forming the second layer, a first insulating layer comprising the glass component contained in the second layer is simultaneously formed on the surface of the varistor body exposed from the first layer, and in the step of forming the third layer, a second insulating layer comprising the glass component contained in the third layer is simultaneously formed on the first insulating layer.

6. A monolithic chip varistor comprising:

a varistor body comprising a plurality of varistor layers comprising a zinc oxide-based ceramic material and at least one pair of internal electrodes opposed to each other with one of the varistor layers therebetween; and a pair of external electrodes, each formed on respective exterior portions of the varistor body, each external electrode being electrically connected to a respective one of the internal electrodes opposed to each other with a specific varistor layer therebetween, wherein each external electrode comprises a first layer formed on the respective exterior portions of the varistor body on which such external electrode is formed and electrically connected to the internal electrodes, a second layer formed on the first layer, a third layer formed on the second layer, a fourth layer formed on the third layer, and a fifth layer formed on the fourth layer;

the first layer contains a metal component and a glass component, the second layer contains a glass component, the third layer contains a glass component which is different from the glass component contained in the second layer, the fourth layer contains a metal component which is different from the metal component contained in the first layer, and the fifth layer contains an electroplating film comprising a metal having satisfactory solderability; and the second layer and the third layer further contain the metal component contained in the fourth layer.

7. A monolithic chip varistor according to claim 6, wherein the first layer contains 5% to 10% by weight of the glass component relative to the metal component.

8. A monolithic chip vari stor according to any one of claims 6 and 7, wherein the fourth layer contains less than 5% by weight of the glass component relative to the metal component.

9. A monolithic chip varistor according to any one of claims 6 and 7, further comprising a first insulating layer comprising the glass component contained in the second layer formed on the exterior portion of the varistor body other than the portion for forming the external electrode, and a second insulating layer, comprising the glass component contained in the third layer, formed on the first insulating layer.

10. A monolithic chip varistor according to claim 8, further comprising a first insulating layer, further comprising a first insulating layer comprising the glass component contained in the second layer formed on the exterior portion of the varistor body other than the portion for forming the external electrode, and a second insulating layer, comprising the glass component contained in the third layer, formed on the first insulating layer.

11. A monolithic chip varistor according to any one of claims 6 and 7, wherein the metal component contained in the first layer comprises Ag or an AgPd alloy, the metal component contained in the second layer and the third layer comprises Ag, and the metal component contained in the fourth layer comprises Ag.

12. A monolithic chip varistor according to claim 9, wherein the metal component contained in the first layer comprises Ag or an AgPd alloy, the metal component contained in the second layer and the third layer comprises Ag, and the metal component contained in the fourth layer comprises Ag.

13. A monolithic chip varistor according to claim 10, wherein the metal component contained in the first layer comprises Ag or an AgPd alloy, the metal component contained in the second layer and the third layer comprises Ag, and the metal component contained in the fourth layer comprises Ag.

14. A monolithic chip varistor according to any one of claims 6 and 7, wherein the glass component contained in the second layer comprises boron-silica-zinc-based glass, and the glass component contained in the third layer comprises lead-boron-silica-zinc-based glass.

15. A monolithic chip varistor according to claim 10, wherein the glass component contained in the second layer comprises boron-silica-zinc-based glass, and the glass component contained in the third layer comprises lead-boron-silica-zinc-based glass.

16. A monolithic chip varistor according to claim 12, wherein the glass component contained in the second layer comprises boron-silica-zinc-based glass, and the glass component contained in the third layer comprises lead-boron-silica-zinc-based glass.

17. A monolithic chip varistor according to claim 13, wherein the glass component contained in the second layer comprises boron-silica-zinc-based glass, and the glass component contained in the third layer comprises lead-boron-silica-zinc-based glass.

18. A monolithic chip varistor according to any one of claims 6 and 7, wherein the glass component contained in the first layer comprises at least one material selected from the group consisting of lead, boron, and silica.

19. A monolithic chip varistor according to claim 10, wherein the glass component contained in the first layer comprises at least one material selected from the group consisting of lead, boron, and silica.

20. A monolithic chip varistor according to claim 12, wherein the glass component contained in the first layer comprises at least one material selected from the group consisting of lead, boron, and silica.

21. A monolithic chip varistor according to claim 13, wherein the glass component contained in the first layer comprises at least one material selected from the group consisting of lead, boron, and silica.

22. A monolithic chip varistor according to claim 15, wherein the glass component contained in the first layer comprises at least one material selected from the group consisting of lead, boron, and silica.

23. A monolithic chip varistor according to claim 16, wherein the glass component contained in the first layer comprises at least one material selected from the group consisting of lead, boron, and silica.

24. A monolithic chip varistor according to claim 17, wherein the glass component contained in the first layer comprises at least one material selected from the group consisting of lead, boron, and silica.

* * * * *